US007766465B2

(12) United States Patent
Shrivastava

(10) Patent No.: US 7,766,465 B2
(45) Date of Patent: Aug. 3, 2010

(54) SYSTEM FOR ALIGNING A CHARGE TUNNEL OF AN INK JET PRINTER

(75) Inventor: Dilip K. Shrivastava, Bensenville, IL (US)

(73) Assignee: Videojet Technologies Inc.

( * ) Notice: Subject to any disclaimer, the term of this patent is extended or adjusted under 35 U.S.C. 154(b) by 515 days.

(21) Appl. No.: 11/772,682

(22) Filed: Jul. 2, 2007

(65) Prior Publication Data

US 2008/0012912 A1 Jan. 17, 2008

Related U.S. Application Data

(63) Continuation of application No. 11/154,290, filed on Jun. 16, 2005, now Pat. No. 7,252,373.

(60) Provisional application No. 60/580,976, filed on Jun. 17, 2004.

(51) Int. Cl.
*B41J 2/085* (2006.01)

(52) U.S. Cl. ..... 347/76

(58) Field of Classification Search ..... 347/73, 347/74, 76, 78, 82, 90
See application file for complete search history.

(56) References Cited

U.S. PATENT DOCUMENTS 4,277,790 A * 7/1981 Heibein et al. ..... 347/49
4,520,367 A * 5/1985 Ishikawa et al. ..... 347/74
4,672,390 A 6/1987 Ishikawa
5,420,624 A 5/1995 Braun et al.
5,475,409 A 12/1995 Simon et al.
5,477,254 A 12/1995 Stephens
5,808,642 A 9/1998 Zaba et al.
5,943,077 A 8/1999 Zaba et al.
2001/0040603 A1 11/2001 Van De Kruys
2003/0184620 A1 10/2003 Shrivastava et al.

FOREIGN PATENT DOCUMENTS

WO WO9416898 8/1994
WO WO9828144 7/1998
WO WO9828152 7/1998

OTHER PUBLICATIONS

International Search Report and Written Opinion for PCT/EP2005/006439 mailed Sep. 20, 2005.

* cited by examiner

*Primary Examiner*—K. Feggins
(74) *Attorney, Agent, or Firm*—Joseph Yosick

(57) ABSTRACT

A system and method of aligning a charge tunnel of a continuous inkjet printer with a drop generator and a catcher, wherein the charge tunnel passes through an outer wall of a charge tunnel unit, including adjusting a linear position of the charge tunnel unit, and adjusting a rotary position of the charge tunnel unit. The adjusting steps are performed to ensure that the charge tunnel is aligned with the drop generator and the catcher.

10 Claims, 5 Drawing Sheets

SYSTEM FOR ALIGNING A CHARGE TUNNEL OF AN INK JET PRINTER

RELATED APPLICATIONS

This application is a continuation of U.S. patent application Ser. No. 11/154,290 entitled "System for Aligning a Charge Tunnel of an Ink Jet Printer," filed Jun. 16, 2005, which relates to and claims priority benefits from U.S. Provisional Patent Application No. 60/580,976 entitled "System for Aligning a Charge Tunnel of an Ink Jet Printer," filed Jun. 17, 2004, both of which are incorporated by reference herein in its entireties.

BACKGROUND OF THE INVENTION

Embodiments of the present invention generally relate to a continuous ink jet printer in which a stream of ink is broken into individual droplets which are then charged and deflected as required in order to form indicia on a substrate. In particular, embodiments of the present invention relate to a system for aligning a charge tunnel with other components of an ink jet printer.

A continuous inkjet printhead typically incorporates a drop generator having a nozzle that breaks an ink stream into uniformly spaced droplets. The ink drops can typically vary in diameter from 0.003-0.009 inch. The ink drops formed by a nozzle are charged in a charge tunnel which allows them to be deflected in a high voltage field to desired spots on a substrate. For optimum charging of drops, the charge tunnel gap is as narrow as practical considerations allow. In order for the printhead to run clean, it is desirable to align the ink stream well centered in the charge tunnel and into the catcher to gather the non-deflected drops.

Typically, the components of a printhead, including the drop generator, the charge tunnel, and the catcher, need to be aligned properly during servicing and normal use, in order to ensure that the printing system operates properly. In order to properly align these components, many printing systems include additional alignment components used in conjunction with a printhead to properly align the ink stream. These components add size and expense to the printhead.

Thus, a need exists for an efficient and accurate way to align the printhead components.

BRIEF SUMMARY OF THE INVENTION

Certain embodiments of the present invention provide a charge tunnel alignment system including a charge tunnel main body, a charge tunnel unit, and first and second fasteners. The charge tunnel main body is defined by lower and upper surfaces, first and second sides, a drop entrance surface and a drop exit surface. A charge tunnel unit channel extends from the upper surface to the lower surface.

The charge tunnel unit is positioned within the charge tunnel unit channel. The charge tunnel unit includes an outer wall, a tab extending from the outer wall, and a charge tunnel passing through the outer wall.

The first fastener passes through the main body and operatively connects to the tab. The charge tunnel unit may be adjusted in a rotary fashion through an engagement of the first fastener. That is, the first fastener, such as a screw, may be engaged through a screw driver to tighten or loosen the fastener.

The second fastener passes through one of the first and second sides of the main body. The second fastener is operatively connected to the charge tunnel unit, such that when the second fastener is engaged, the charge tunnel unit adjusts the charge tunnel unit in either a lateral or radial direction. The second fastener may be a worm screw or camming device, and the charge tunnel unit further includes a reciprocal structure that operatively receives the second fastener.

The charge tunnel alignment system may also include a bracket defining a housing slot, wherein the charge tunnel housing is slidably retained within the housing slot. At least one bracket fastener may pass through the bracket and operatively connect to the upper surface of the charge tunnel housing.

Certain embodiments of the present invention provide a method of aligning a charge tunnel of a continuous inkjet printer with a drop generator and a catcher. The method includes adjusting a linear position of the charge tunnel unit, and adjusting a rotary position of the charge tunnel unit. The adjusting steps are performed to ensure that the charge tunnel is aligned with the drop generator and the catcher. The linear adjusting steps may occur in horizontal and vertical linear directions. Fasteners are engaged that are either directly or indirectly operatively connected to the charge tunnel unit.

The adjusting a linear position includes tightening a fastener that is operatively connected to the charge tunnel unit to move the charge tunnel unit in a first linear direction, and loosening the fastener to move the charge tunnel unit in a second linear direction. The adjusting a rotary position includes tightening a fastener that is operatively connected to the charge tunnel unit to move the charge tunnel unit in a first rotary direction, and loosening the fastener to move the charge tunnel unit in a second rotary direction.

Figure 1:
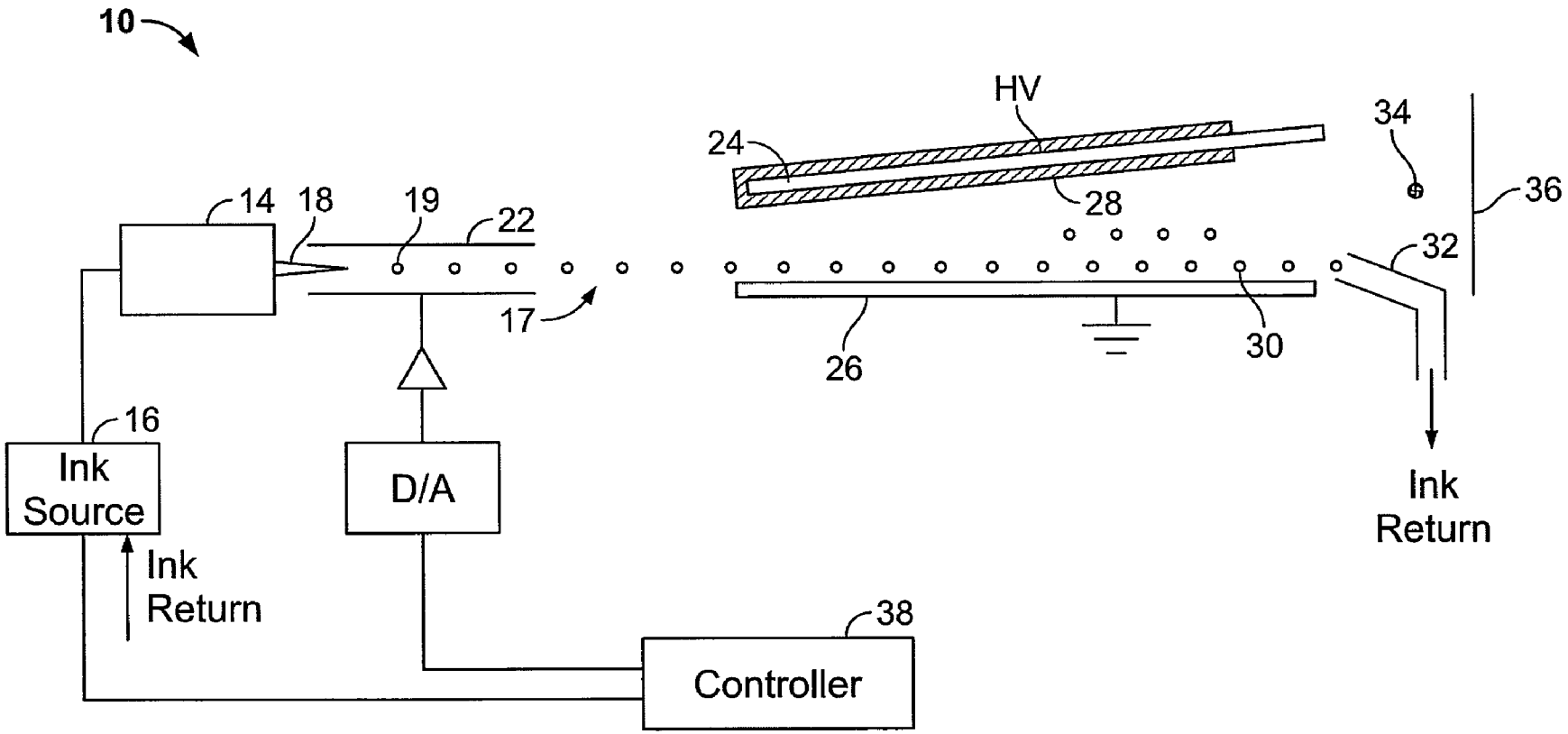
FIG. 1 illustrates a schematic representation of a continuous ink jet printer.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a schematic representation of a continuous ink jet printer 10. The ink jet printer 10 includes a print head with a drop generator 14 connected to receive ink from an ink source 16. The drop generator 14 incorporates a piezoelectric oscillator that creates perturbations in ink flow at a nozzle 18. The nozzle 18 emits a stream 17 of uniformly sized and spaced drops 19. The drops pass through a charging tunnel 22, where a different charge can be applied to each drop 19. The drops subsequently pass between a pair of opposed deflection electrodes 24 and 26. A power source (not shown) is operatively connected to the deflection electrodes 24 and 26 such that a relatively uniform electric field extends between the electrodes 24 and 26. The charge on a given drop determines the amount it deflects vertically as it passes between the electrodes 24 and 26. Insulation 28 may be disposed on at least one of the electrodes 24 and 26 to prevent arcing between the deflection electrodes 24 and 26, and also between the deflection electrodes 24, 26 and the charging tunnel 22.

Uncharged or slightly charged drops 30 pass substantially undeflected to a catcher 32, and are recycled to ink source 16. Charged drops 34 are projected toward a substrate 36 and are deflected so as to have a trajectory striking the substrate 36 as the substrate 36 moves past the print head. The level of charge applied to the drop controls its vertical displacement/position on the substrate 36.

The charge to be applied to a drop is determined by a controller 38, which may be implemented by a device such as a general purpose processor, microcontroller, or embedded controller having appropriate input and output circuitry, as is well known in the art. The controller 38 operates under general program control of the instructions stored in an associated memory. The controller is programmed to deliver control signals to the charge tunnel 22 to control the charges applied to the individual drops 19 as they pass therethrough. The operation of such ink jet printers is well known in the art and, hence, will not be explained in greater detail.

Figure 2:
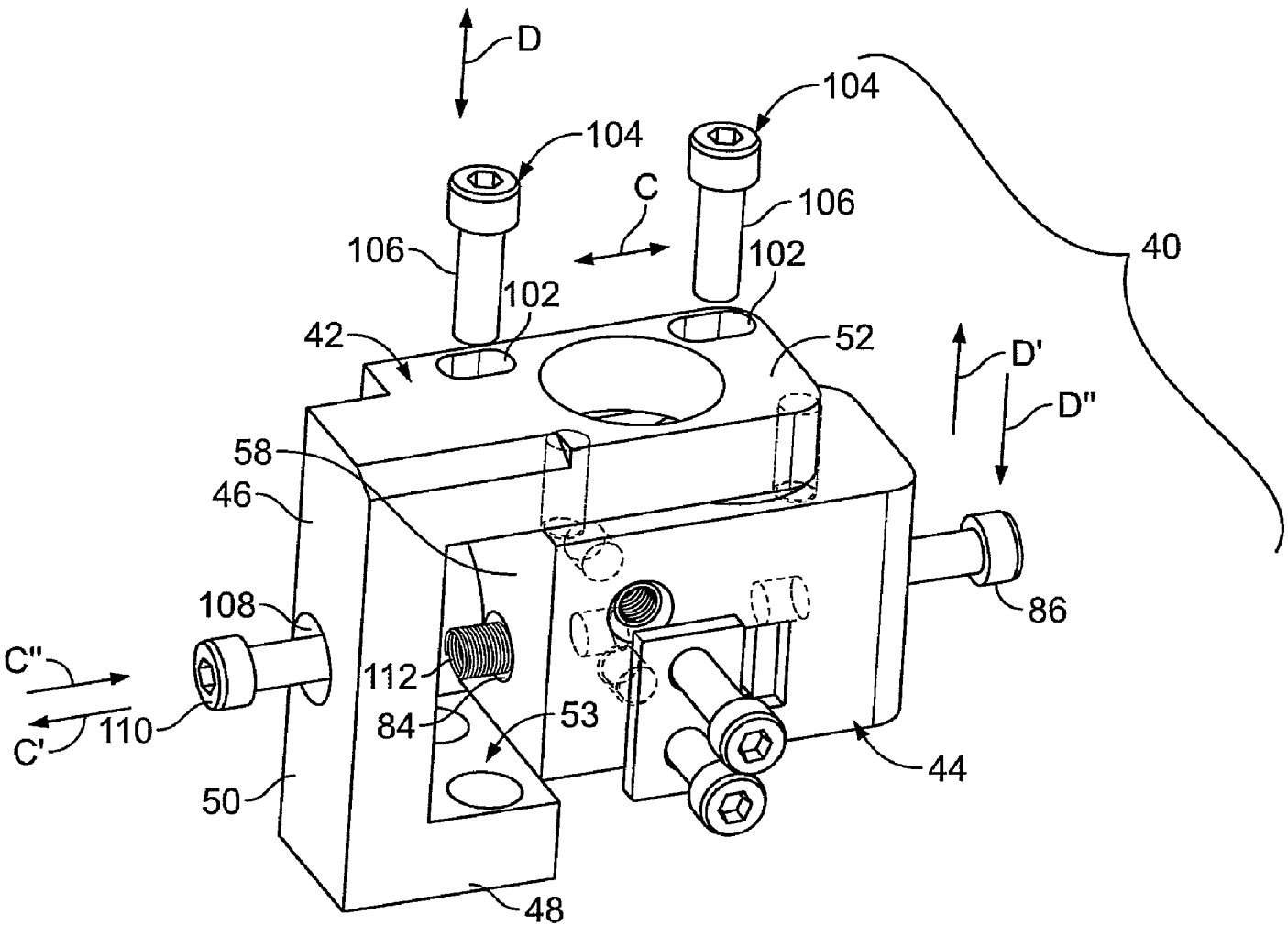
FIG. 2 illustrates an isometric partially exploded view of a charge tunnel alignment system, according to an embodiment of the present invention.

FIG. 2 illustrates an isometric partially exploded view of a charge tunnel alignment system 40, according to an embodiment of the present invention. The system 40 includes a bracket 42 and a charge tunnel housing 44. The bracket 42 includes a main body 46 defined by a lower ledge 48 integrally formed with an upright member 50, which is in turn integrally formed with an upper ledge 52. A housing slot 54 is defined between the lower ledge 48, the upright member 50 and the upper ledge 52. The charge tunnel housing 44 is configured to be slidably retained within the housing slot 53. That is, the charge tunnel housing 44 may slide in directions denoted by arrow C.

Figure 3:
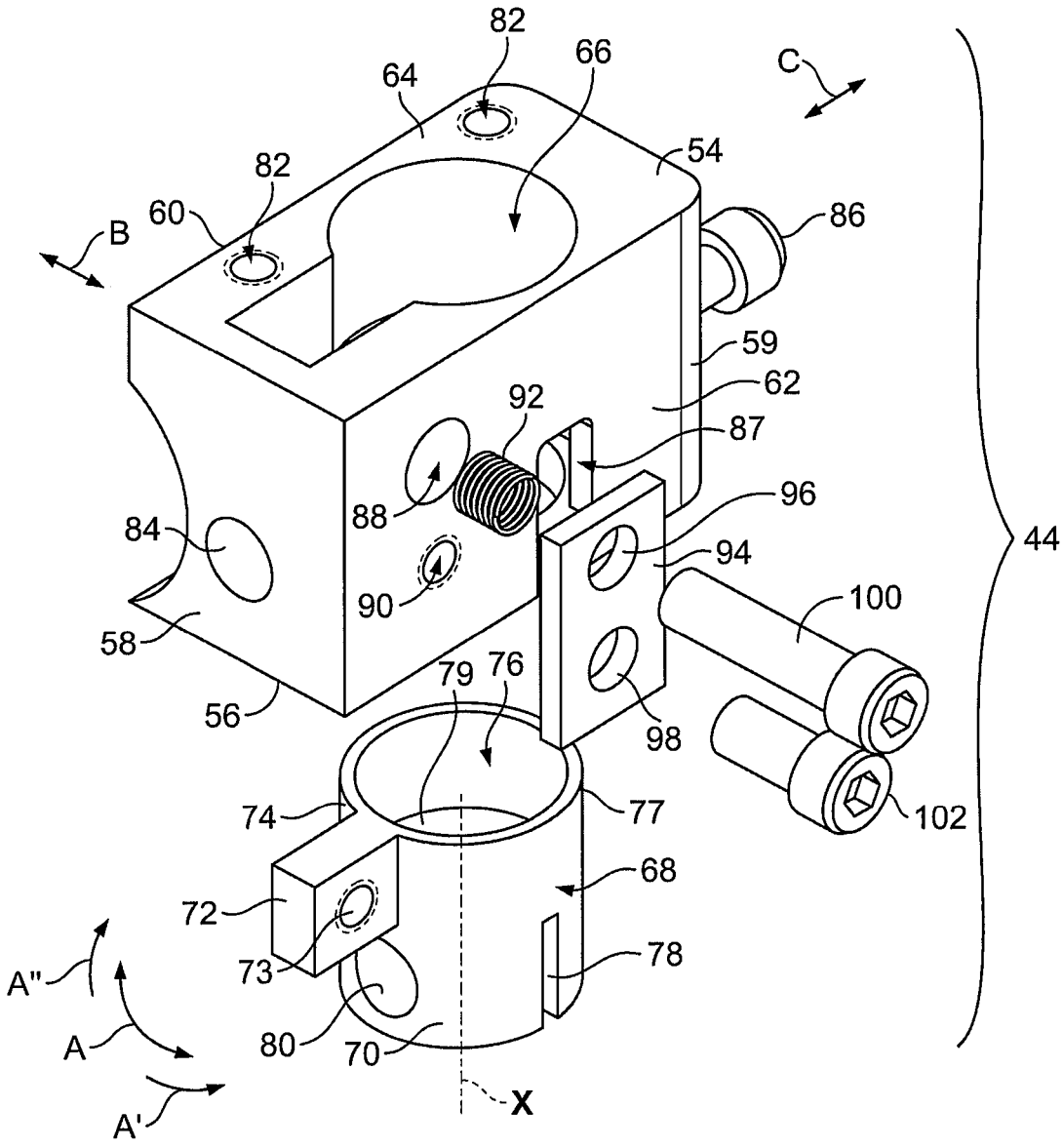
FIG. 3 illustrates an isometric exploded view of a charge tunnel housing, according to an embodiment of the present invention.

FIG. 3 illustrates an isometric exploded view of the charge tunnel housing 44. The charge tunnel housing 44 includes a main body 54 having a lower surface 56 integrally formed with sides 58, 59, a drop entrance surface 60, a drop exit surface 62, and a top surface 64. A charge tunnel unit channel 66 extends from the top surface 64 to the lower surface 56. The charge tunnel unit channel 66 is configured and sized to receive and retain a charge tunnel unit 68.

The charge tunnel unit 68 includes a generally cylindrical main body 70 having an outer wall 77 integrally formed with an outwardly extending tab 72 located at an upper portion 74 of the charge tunnel unit 68. The tab 72 has a fastener through hole 73 formed therethrough. The through hole 73 may be threaded to receive and retain a fastener, such as a screw. Optionally, the through hole 73 may be configured to receive and retain various other fasteners, such as bolts, clips, pins, and the like. The same holds true for other fastener through holes discussed below.

An upper cavity 76 is defined between the outer wall 77 and an intermediate surface 79. A slot 78 is formed through the outer wall 77 of the main body 70 and defines the charge tunnel. That is, the slot 78 passes linearly through the main body 70. A cavity 80 may be formed through the outer wall 77 and is perpendicularly oriented with respect to the slot 78. The cavity 80 extends from the outer wall to a surface within the main body 70 to form a cupped cavity. Optionally, the cavity 80 may be a slightly recessed surface configured to engage a distal end of a fastener.

Fastener through holes 82 are formed through the top surface 64 proximate the drop entrance surface 60 and sides 58 and 59. The through holes 82 are configured to receive and retain fasteners, such as screws, bolts, and the like. Additionally, a channel 84 is formed through the side 58 and is configured to be aligned with, and allow passage to, the cavity 80 formed in the main body 70 of the charge tunnel unit 68. An additional through hole (not shown) is formed through the side 59, and is configured to receive a fastener 86.

The drop exit surface 62 includes a charged drop exit opening 87 that is configured to align with, and allow passage to, the slot (charge tunnel) 78 of the charge tunnel unit 68. A channel 88 is formed through the drop exit surface 62 and extends into the charge tunnel unit channel 66. Additionally, a fastener through hole 90, which may extend into the change tunnel adjustment channel 66, is formed below the channel 88. A spring 92 is positioned within the channel 88. A plate 94 having two holes 96 and 98 is positioned on the drop exit surface 62 so that the holes 96 and 98 are aligned with the channel 88 and through hole 90, respectively.

A fastener 100 passes through the hole 96 and into the channel 88, where the fastener 100 is securably retained (e.g., threadably secured to) by the through hole 73, thereby exerting pressure on the spring 92, and vice versa. The fastener 100 may be tightened or loosened, thereby providing a corresponding force on the spring 92, which abuts the tab 72 around the through hole 73, thereby exerting a force on the tab 72. As the fastener 100 is operatively engaged (either by tightening or loosening), the tab 72 moves in response thereto. The spring 92 exerts a constant force against the tab 72 and against the plate 94 in the directions of arrow B. As the fastener 100 is tightened, the spring 92 compresses. As the fastener 100 is loosened, the spring 92 elongates.

Engagement of the fastener 100 causes the charge tunnel unit 68 to radially move (e.g., move in a rotary fashion) about a central axis X in the directions denoted by arrow A. As the fastener 100 is tightened, the fastener 100 draws the tab 72 toward the drop exit surface 62 in the direction of A'. Thus, the entire charge tunnel unit 68 moves in response. As the fastener 100 is loosened, the fastener 100 begins to retreat from the through hole 73, such that the spring 92 (and the movement of the fastener 100 through the through hole 73) forces the tab 72 to recede in the direction of A", thereby causing a corresponding movement in the charge adjustment member 68. As such, the slot, or charge tunnel 78, may be radially adjusted through an operative engagement of the fastener 100.

A fastener 101 is positioned through the lower hole 98 and is configured to be received and retained within the through hole 90. The fastener 101 ensures that the plate 94 remains secured on the drop exit surface 62 at a constant position. As such, the spring 92 exerts a force on the plate 94, but the plate 94 does not move. Rather, the force exerted by the spring on the plate 94 and the tab 72 causes the tab 72 to move in the direction of A" when the fastener 100 is loosened.

Additionally, the fastener 86 may extend into the charge tunnel unit channel 66 and abut the outer wall 77 of the charge tunnel unit 68. The fastener 86 may be engaged to move into and away from the charge tunnel unit 68 to provide a linear adjustment of the charge tunnel unit 68 in the directions of arrow C. Optionally, the fastener 86 may be used with the charge tunnel unit 68 so that it may adjust the charge tunnel 78 in a rotary fashion. That is, the fastener may be a worm screw, cam mechanism, or like fastener that engages a reciprocal structure on the charge tunnel unit 68, thereby adjusting it in a rotary fashion through directions denoted by arrow A.

Referring to FIGS. 2 and 3, the upper ledge 52 of the bracket 42 includes channels 102 configured to allow fasteners 104 to pass therethrough. The channels 102 are wider than the diameters of the distal ends 106 of the fasteners 106. As such, the fasteners 104 may move in linear directions as shown by arrows C within the channels 102. The charge tunnel housing 44 is secured into the housing slot 53 by way of the fasteners 104 engaging the through holes 82.

The fasteners 104 may be used to lock the charge tunnel housing 44 in a lateral direction. Initially, the charge tunnel housing 44 may be adjusted laterally through the engagement of the fastener 110. Once a desired lateral position is attained, the fasteners 104 may be tightened down to the upper ledge 52 so that the charge tunnel housing 44 is restricted from movement. In order to readjust the central housing in a lateral direction, the fasteners 104 are first loosened in order to allow the charge tunnel housing 44 to move laterally. Optionally, as discussed below, the fasteners 104 may be used to adjust the charge tunnel housing 44 in vertical directions.

A channel 108 extends horizontally through the upright member 50 and allows a fastener 110 to pass therethrough. The channel 108 is aligned with the channel 84 of the charge tunnel housing 44 and the cavity 80 of the charge tunnel unit 68.

A spring 112 is disposed within the channel 84 and abuts the charge tunnel unit 68 around the cavity 80. A distal end of the fastener 110 is disposed through the spring 112 and abuts the charge tunnel unit 68 through the cavity 80. The cavity 80 may be threaded and a distal end of the fastener 110 may threadably engage the cavity 80. When the fastener 110 is tightened, the fastener 110 extends further into the cavity 80. In the process, the fastener 110 draws the charge tunnel housing 44 toward the upright member 50 in the direction of C'. As the fastener 110 is loosened, the fastener 110 recedes from the cavity 80, the spring 84 elongates, and the charge tunnel housing 44 moves away from the upright member 50 in the direction of arrow C". The fastener 86 may be engaged to move the charge tunnel housing 44, as well.

Additionally, the fasteners 104 may be engaged to adjust the charge tunnel assembly 66 in vertical directions denoted by arrows D. For example, when the fasteners 104 are tightened, the charge tunnel assembly 66 may be drawn upward in the direction of arrow D', by way of the fasteners 104 engaging the threaded through holes 82. As the fasteners 104 are loosened, the charge tunnel unit 68 recedes from the upper ledge 52 in the direction of arrow D".

The fasteners 110 and 86 may be engaged to adjust the charge tunnel unit 68, and therefore the slot (charge tunnel) 78 in linear directions defined by arrow C. The lateral range of movement of the charge tunnel unit 68 is limited by the range of movement of the fasteners 106 through the channels 102.

As the fastener 110 is tightened, it exerts a force into the charge tunnel unit 68 in the direction of arrow C', thereby pressing the charge tunnel unit 68 into charge tunnel unit channel 66 and causing the charge tunnel housing 44 to move in the same direction. Optionally, the fastener 110 and spring 112 may abut an outer wall portion (e.g., the side 58) of the charge tunnel housing 68, instead of directly abutting a portion of the charge tunnel unit 68. In either case, when the fastener 110 is tightened, the charge tunnel housing 44 (and therefore the charge tunnel 78) move in the same direction. Also, if the fastener 86 is configured to adjust the charge tunnel housing 44 laterally, the fastener 86 may be loosened, thereby receding away from the charge tunnel unit 68. As such the charge tunnel 78 moves in the direction of arrow C'.

Figure 4:
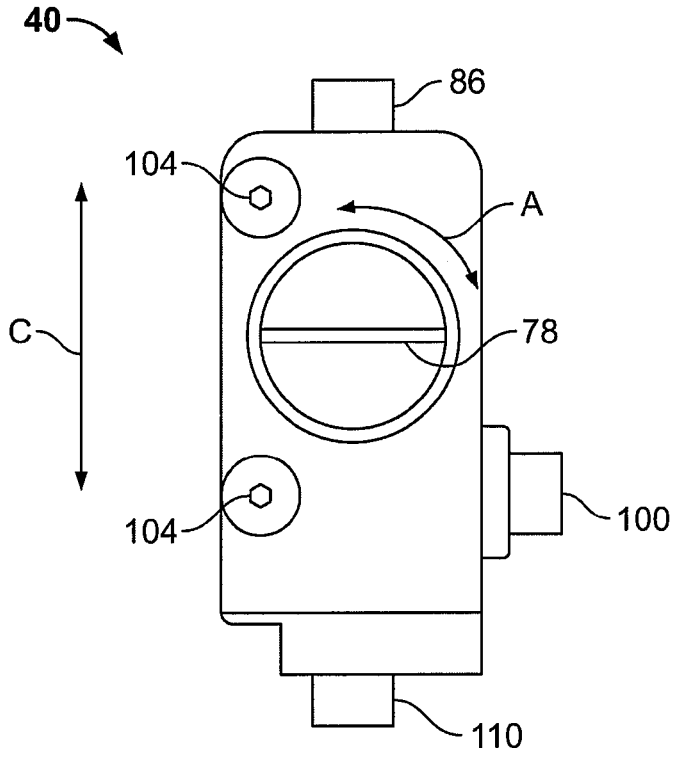
FIG. 4 illustrates a top view of a charge tunnel alignment system, according to an embodiment of the present invention.

FIG. 4 illustrates a top view of the charge tunnel alignment system 10. In order to adjust the charge tunnel 78 in a rotary fashion as denoted by arrow A, fastener 100 is engaged, as discussed above. To adjust the charge tunnel 78 in a horizontal linear fashion, the fasteners 110 and 86 are engaged, as discussed above. Optionally, the fastener 86 may be used to adjust the charge tunnel 78 in the directions of arrow A. In order to adjust the charge tunnel housing 44 (as shown and discussed above) through vertical directions, the fasteners 104 may be engaged as discussed above.

Figure 5:
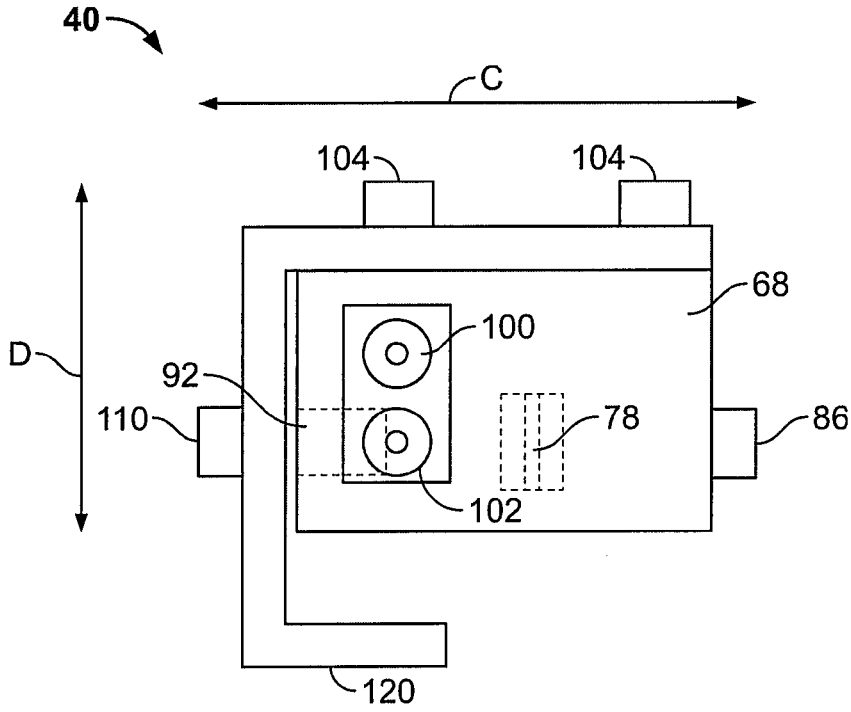
FIG. 5 illustrates a front view of a charge tunnel alignment system, according to an embodiment of the present invention.

FIG. 5 illustrates a front view of the charge tunnel alignment system 10. In order to adjust the charge tunnel 78 in a rotary fashion, the fastener 100 is engaged, as discussed above. Optionally, the fastener 86 may also assist in rotary adjustment of the charge tunnel 78. The fasteners 104 are engaged to adjust the charge tunnel 78 in directions denoted by arrow D. Further, the fastener 110 is used to adjust the charge tunnel linearly in directions denoted by arrow C. The fastener 110 and spring 92 may abut against the fastener 101, as shown in FIG. 5, instead of abutting against the charge tunnel unit 68, as discussed above. The charge tunnel alignment system 40 may be positioned on a mount 120, which may be secured to a printhead deck (not shown).

Figure 6:
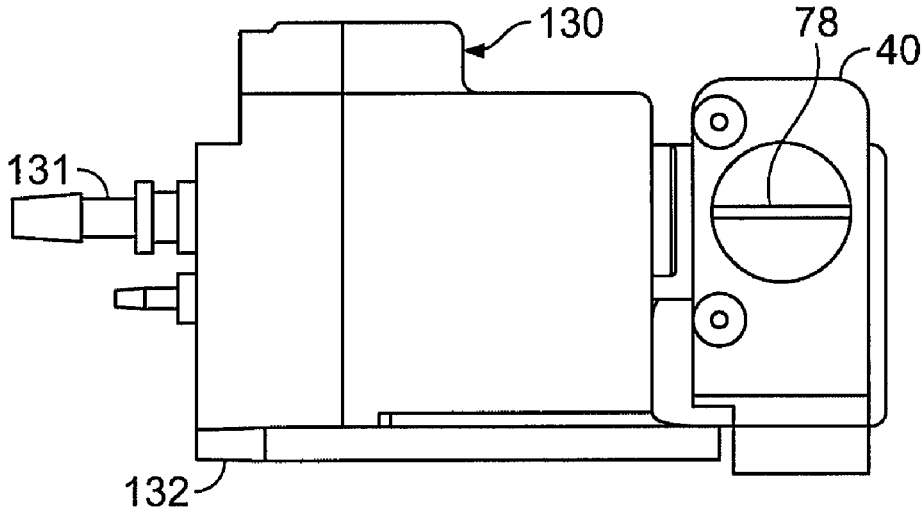
FIG. 6 illustrates a top view of a charge tunnel alignment system and drop generator, according to an embodiment of the present invention.
Figure 7:
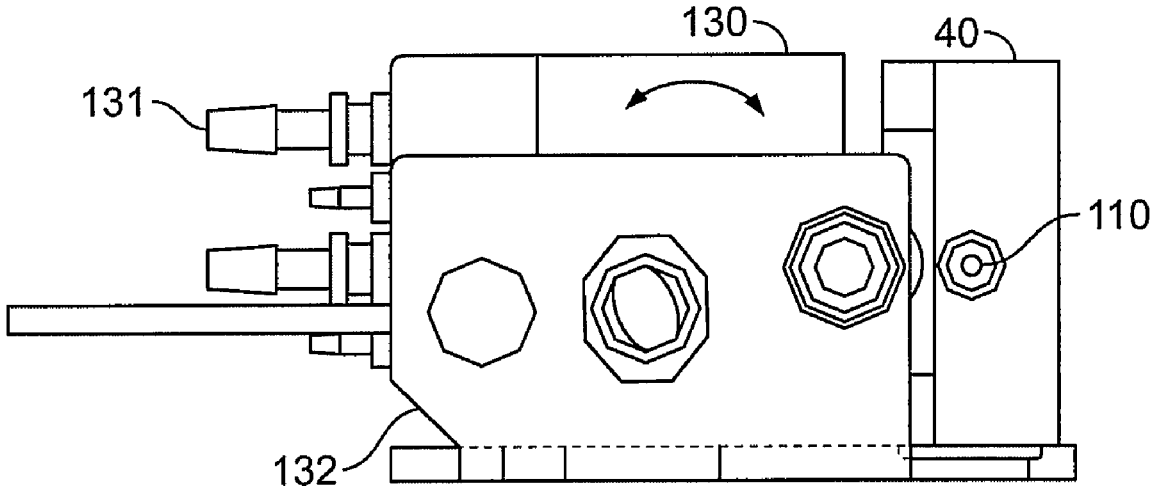
FIG. 7 illustrates a side view of a charge tunnel alignment system and drop generator, according to an embodiment of the present invention.

FIG. 6 illustrates a top view of the charge tunnel alignment system 40 and a drop generator 130 having a nozzle 131. FIG. 7 illustrates a side view of the charge tunnel alignment system 40 and the drop generator 130. An alignment cradle 132 is used to secure the system 40 and the drop generator 130. The drop generator 130 may be adjusted in a vertical plane as shown in side view of FIG. 2, which is commonly known.

The independent linear and rotary adjustments of the charge tunnel assembly, as discussed above, ensures proper passage of the ink stream from the drop generator 130 through the charge tunnel 78. Also when the alignment cradle 132 is aligned horizontally to direct the ink stream into the catcher, the charge tunnel assembly 40 follows the alignment cradle and no further adjustment of the charge tunnel assembly 40 is required.

In general, the charge tunnel alignment system 40 may be removed from the printer 10 in order for the charge tunnel 78 to be adjusted. Optionally, the charge tunnel alignment system 40 may be adjusted while it is secured within the printer 10. The charge tunnel 78 may be adjusted manually by an operator engaging the fasteners through a tool, such as a screwdriver. Alternatively, the fasteners may be operatively connected to actuators, servo motors, and the like, which may in turn be in operative communication with a controller. The actuators, and the like, may operate to automatically adjust the charge tunnel 78 by engaging the various fasteners.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A charge tunnel alignment system comprising:

a drop generator;

a catcher; and a charge tunnel unit configured to be adjusted in a rotary direction and one or both of lateral and/or radial directions.

2. The charge tunnel alignment system of claim 1, wherein said charge tunnel unit is adjusted to ensure that said charge tunnel unit is aligned with said drop generator and said catcher.

3. The charge tunnel alignment system of claim 1, further comprising a first fastener operatively connected to said charge tunnel unit, wherein said first fastener is tightened to move said charge tunnel unit in a first rotary direction, and wherein said first fastener is loosened to move said charge tunnel unit a second rotary direction.

4. The charge tunnel alignment system of claim 3, further comprising a spring disposed between said charge tunnel unit and said first fastener, wherein said spring is compressed when said first fastener is tightened, and wherein said spring elongates when said first fastener is loosened.

5. The charge tunnel alignment system of claim 1, further comprising a second fastener operatively engaging said charge tunnel unit to adjust said charge tunnel unit in one or both of said lateral and/or radial directions.

6. A charge tunnel alignment system configured for use with a continuous ink jet printer, the system comprising:

a charge tunnel unit;

a first fastener operatively connected to said charge tunnel unit; and a second fastener operatively engaging said charge tunnel unit to adjust said charge tunnel unit in one of lateral or radial directions;

wherein said charge tunnel unit is adjusted in a rotary fashion through an engagement of said first fastener.

7. The charge tunnel alignment system of claim 6, wherein said first fastener is tightened to move said charge tunnel unit in a first rotary direction, and wherein said first fastener is loosened to move said charge tunnel unit a second rotary direction.

8. The charge tunnel alignment system of claim 7, further comprising a main body having a drop entrance surface, a drop exit surface, and a charge tunnel unit channel, said charge tunnel unit being positioned within said charge tunnel unit channel, and wherein said first fastener passes through said drop exit surface.

9. The charge tunnel alignment system of claim 6, wherein said second fastener is a worm screw or camming mechanism.

10. The charge tunnel alignment system of claim 6, further comprising a spring disposed between said charge tunnel unit and said first fastener, wherein said spring is compressed when said first fastener is tightened, and wherein said spring elongates when said first fastener is loosened.

* * * * *